US006894009B2

(12) United States Patent
Kawamura et al.

(10) Patent No.: US 6,894,009 B2
(45) Date of Patent: May 17, 2005

(54) GREASE COMPOSITION FOR CONSTANT VELOCITY JOINTS

(75) Inventors: Yasushi Kawamura, Tokyo (JP); Kouichi Nakazawa, Tokyo (JP); Noriaki Shinoda, Tokyo (JP); Keiji Tanaka, Tokyo (JP); Tetsuo Nimura, Toyota (JP); Kouji Saitou, Toyota (JP); Tomoyasu Wada, Toyota (JP)

(73) Assignee: Shell Oil Company, Houston, TX (US)

( * ) Notice: Subject to any disclaimer, the term of this patent is extended or adjusted under 35 U.S.C. 154(b) by 140 days.

(21) Appl. No.: 10/204,958

(22) PCT Filed: Feb. 28, 2001

(86) PCT No.: PCT/EP01/02325

§ 371 (c)(1),
(2), (4) Date: Aug. 27, 2002

(87) PCT Pub. No.: WO01/64821

PCT Pub. Date: Sep. 7, 2001

(65) Prior Publication Data

US 2003/0027728 A1 Feb. 6, 2003

(30) Foreign Application Priority Data

Feb. 29, 2000 (JP) ..... 2000-055026

(51) Int. Cl.[7] ..... C10M 101/02

(52) U.S. Cl. ..... 508/273; 508/369; 508/379; 508/380; 508/363; 508/433; 508/552

(58) Field of Search ..... 508/273, 363, 508/379, 380, 369, 433, 552

(56) References Cited

U.S. PATENT DOCUMENTS

| | | | | |
|---|---|---|---|---|
| 4,517,103 A | | 5/1985 | Hoffman et al. | |
| 4,840,740 A | | 6/1989 | Sato et al. | |
| 5,207,936 A | * | 5/1993 | Anzai et al. | 508/168 |
| 5,952,273 A | | 9/1999 | Suzuki et al. | 141/12 |

FOREIGN PATENT DOCUMENTS

| | | | |
|---|---|---|---|
| EP | 0 633 304 B1 | 2/1998 | C10M/169/06 |
| JP | 62-207397 | 9/1987 | C10M/169/00 |
| JP | 63162791 | 7/1988 | C10M/169/06 |
| JP | 4032800 | 12/1991 | G01N/23/04 |
| JP | 4034590 | 2/1992 | G09F/21/06 |
| JP | H4-34590 | 6/1992 | |
| JP | 6057283 | 3/1994 | C10M/169/06 |
| JP | 6330072 | 1/1995 | C10M/169/06 |
| JP | 10147791 | 6/1998 | C10M/169/06 |
| JP | 10273692 | 10/1998 | C10M/169/06 |
| JP | 11131086 | 5/1999 | C10M/169/06 |
| WO | 94 11470 | 5/1994 | C10M/169/06 |

OTHER PUBLICATIONS

T. Sakurai's "Sekiyu Seihin Tenkazai," [Petroleum Product Additives] (p. 262 and thereafter) and Table 3 on p. 266, (no date).

* cited by examiner

*Primary Examiner*—Elizabeth D. Wood

(57) ABSTRACT

A grease composition for constant velocity joints, having a base oil and a urea-based thickener, which grease additionally contains, (A) molybdenum sulphide dialkyldithiocarbamate and (B) 5,5-dithiobis (1,3,4-thiadiazole-2-thiol); a method of lubricating a constant velocity joint including packing it with grease and a constant velocity joint packed with said grease.

10 Claims, No Drawings

GREASE COMPOSITION FOR CONSTANT VELOCITY JOINTS

FIELD OF THE INVENTION

The present invention relates to a grease composition for constant velocity joints, a method of lubricating a constant velocity joint and to a constant velocity joint packed with a grease. In particular, the present invention relates to a grease composition which can be used for automobile drive shafts, propeller shafts and industrial machinery joints.

BACKGROUND OF THE INVENTION

Recent progress in mechanical technology has seen a growing demand for the reduction in size and weight of machines, the enhancement of machine precision, the prolongation of machine life and so forth.

Constant velocity joints are special types of universal couplings which can transmit drive from the final reduction gear to a road wheel axle at constant rotation velocity.

As the constant velocity joints used in automobiles and industrial machines are used at high speeds and under high surface pressure conditions, much better performance is demanded of the grease used to lubricate these joints. This situation will be described in more detail below with reference to constant velocity joints (herein below abbreviated to CVJ) for automobiles.

With the promotion of front wheel drive cars and four wheel drive cars and the like, there has been a marked increase in the use of CVJ in the automobile industry. Cars now have higher output and are smaller and lighter, which imposes severe demands on CVJ durability.

The grease used for CVJ lubrication is also subjected to the demands for better joint durability and lifetime (damage resistance, for example, flaking resistance and seizing resistance).

In response to these demands, sulphur-phosphorus-based extreme-pressure agents comprising sulphurated fat/oil and/or olefin sulphide combined with zinc dithiophosphate, and lithium grease comprising lead-based additives and molybdenum disulphide and the like have mainly been used commercially. In recent years, urea grease, which has excellent heat resistance, has been used more than lithium grease.

Examples of prior art techniques which involve the use of a molybdenum sulphide dialkyldithiocarbamate include Japanese Examined Patent Application No. H4-34590 and Japanese Unexamined Patent Application Nos. H6-57283, H6-330072 and H10-273692.

Japanese Examined Patent Publication No. H4-34590 discloses a system comprising:—(A) molybdenum sulphide dialkyldithiocarbamate; and (B) at least one sulphur-phosphorus-based extreme pressure additive chosen from the group consisting of sulphurated fat/oil, olefin sulphide, tricresyl phosphate, trialkylthiophosphate and zinc dialkyldithiophosphate, compounded into urea grease. However, such systems cannot always be said to be satisfactory under the current severe CVJ working conditions.

Japanese Unexamined Patent Application No. H6-57283 discloses a system comprising molybdenum sulphide dialkyldithiocarbamate, molybdenum disulphide and lead sulphide dialkyldithiocarbamate, compounded into urea grease. However, as this system contains a lead-based additive, it is undesirable in view of increasing concerns over environmental protection.

Japanese Unexamined Patent Application No. H6-330072 discloses adding both (A) molybdenum sulphide dialkyldithiocarbamate and (C) triphenylphosphorothionate to urea grease, but these systems do not simultaneously yield satisfactory damage resistance and abrasion resistance.

T. Sakurai's "Sekiyu Seihin Tenkazai" [Petroleum Product Additives] (p. 262 and thereafter) introduces thiadiazole compounds as lubricant oil additives, and Table 3 on p. 266 suggests that the addition of thiadiazole-based compounds results in excellent sulphuration corrosion prevention with respect to copper and silver. Moreover, Japanese Examined Patent publication No. H4-32880 discloses improved load resistance and extreme pressure properties without corrosion or discoloration of the metal as a result of adding 5,5'-dithiobis(1,3,4-thiadiazole-2-thiol) to lubricating grease, but no mention is made of the problem of balancing damage resistance and abrasion resistance.

Japanese Unexamined Patent Application No. H11-131086 discloses the use of a thiadiazole-based compound as an additive in lubricating grease obtained using a calcium sulphonate complex-based thickening agent, but the thiadiazole-based compound is used here to deactivate metals.

Japanese Unexamined Patent Application No. H10-273692 discloses a grease composition for constant velocity joints comprising diurea as thickener, wherein molybdenum disulphide, phosphorus-free sulphur-based extreme pressure additive and sulphur-nitrogen-based extreme pressure additive are used in combination with (A) molybdenum sulphide dialkyldithiocarbamate. However, it is not clear which specific compounds can be used as the sulphur-nitrogen-based extreme-pressure agent, as "Vanlube 601" (trademark), manufactured by R. T. Vanderbilt, is merely disclosed in the working examples, and said trade name merely confirms that "Vanlube 601" is a heterocyclic sulphur-nitrogen compound. Moreover, according to this technique, the combined use of molybdenum disulphide and phosphorus-free sulphur-based extreme pressure additive is indispensable.

EP-A-0633 304 discloses a urea grease composition comprising a urea grease and, incorporated therein as additives, a sulfurized molybdenum dialkyldithiocarbamate represented by formula (A):-

$$(R_1R_2N—CS—S)_2—Mo_2O_mS_n$$

wherein $R_1$, and $R_2$ each independently represent an alkyl group having from 1 to 24 carbon atoms, m+n=4, m is 0 to 3, and n is 4 to 1, and triphenylphosphorothionate (B).

There is a demand for both satisfactory damage resistance and satisfactory abrasion resistance in the field of lubricating grease compositions for constant velocity joints. There are many greases which have good abrasion resistance but poor damage resistance. There is considerable demand for the discovery of a grease composition for constant velocity joints which provides improvement in both of these physical properties.

It has now been found possible to formulate greases for constant velocity joints containing 5,5'-dithiobis(1,3,4-thiadiazole-2-thiol), having advantageous properties with regard to damage resistance and abrasion resistance.

SUMMARY OF THE INVENTION

The present invention provides a grease composition for constant velocity joints comprising a base oil and a urea-based thickener, which grease additionally contains, (A) molybdenum sulphide dialkyldithiocarbamate; and (B) 5,5'-dithiobis(1,3,4-thiadiazole-2-thiol).

DETAILED DESCRIPTION OF THE INVENTION

In a preferred embodiment, the grease composition of the present invention further contains, (C) triphenylphosphorothionate.

The molybdenum sulphide dialkyldithiocarbamate (A) may conveniently be a compound represented by general formula (1) below:-

$$(R^1R^2N—CS—S)_2—Mo_2O_mS_n \quad (1)$$

wherein $R^1$ and $R^2$ are groups independently chosen from the group consisting of alkyl groups of from 1 to 24 carbon atoms, m+n=4, m is from 0 to 3 and n is from 1 to 4.

Preferred alkyl groups are those having from 1 to 18 carbon atoms, more preferably from 1 to 12 carbon atoms, even more preferably from 1 to 6 carbon atoms and most preferably from 1 to 4 carbon atoms. Said alkyl groups maybe linear or branched.

Specific examples of molybdenum sulphide dialkyldithiocarbamate (A) that may be conveniently used in the present invention include one or more of molybdenum sulphide diethyldithiocarbamate, molybdenum sulphide dibutyldithiocarbamate, molybdenum sulphide diisobutyldithiocarbamate, molybdenum sulphide di(2-ethylhexyl)dithiocarbamate, molybdenum sulphide diamyldithiocarbamate, molybdenum sulphide diisoamyldithiocarbamate, molybdenum sulphide dilauryldithiocarbamate, molybdenum sulphide distearyldithiocarbamate, molybdenum sulphide n-butyl-2-ethylhexyldithiocarbamate and molybdenum sulphide 2-ethylhexylstearyldithiocarbamate.

5,5'-dithiobis(1,3,4-thiadiazole-2-thiol) (B) may be represented by formula (2) below:-

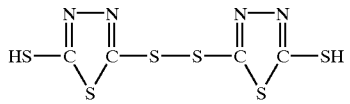

(2)

Preferred compositions according to the invention have one or more of the following features:

(i) from about 0.5% to about 10% by weight of A;
(ii) from about 0.5% to about 5% by weight of A;
(iii) at least about 2% by weight of A;
(iv) up to about 3% by weight of A;
(v) from about 0.1% to about 10% by weight of B;
(vi) from about 0.1% to about 5% by weight of B;
(vii) at least about 0.5% by weight of B, and
(viii) up to about 2% by weight of B, with respect to the total weight of the grease composition.

Particularly preferred compositions according to the invention are those having features (i) and (v); those having features (i) and (vi); those having features (i) and (vii); those having features (i) and (viii); those having features (i), (vii) and (viii); those having features (ii) and (v); those having features (ii) and (vi); those having features (ii) and (vii); those having features (ii) and (viii); those having features (ii), (vii) and (viii); those having features (iii) and (v); those having features (iii) and (vi); those having features (iii) and (vii); those having features (iii) and (viii); those having features (iii), (vii) and (viii); those having features (iv) and (v); those having features (iv) and (vi); those having features (iv) and (vii); those having features (iv) and (viii); those having features (iv), (vii) and (viii); those having features (iii), (iv) and (v); those having features (iii), (iv) and (vi); those having features (iii), (iv) and (vii); those having features (iii), (iv) and (viii); and those having features (iii), (iv), (vii) and (viii).

If less than about 0.5% by weight of A is used, a reduced effect on the CVJ damage resistance is achieved, whereas there is no incentive to use more than about 10% by weight of A, as above this concentration limited or no further improvement can be expected.

If less than about 0.1% by weight of B is used, a reduced effect on the CVJ damage resistance is achieved, whereas there is no incentive to use more than about 10% by weight of B, as above this concentration limited or no further improvement can be expected.

The triphenylphosphorothionate (C) is a compound represented by formula (3) below:-

$$(C_6H_5—O)_3—P=S \quad (3)$$

When triphenyiphosphorothionate (C) is added, it is preferably incorporated in a concentration of up to about 10% by weight, e.g., from about 0.1% to about 10% by weight, more preferably from about 0.1% to about 5% by weight, with respect to the total weight of the grease composition.

If less than about 0.1% by weight of C is added, a reduced effect on the abrasion resistance is achieved, whereas there is no incentive to use more than about 10% by weight of C, as above this concentration limited or no further improvement can be expected.

Any urea-based thickener can be used as the urea compound used for the thickener, and there are no particular limitations on the type thereof. For example, diurca, triurea and/or tetraurea may be conveniently used. Mineral oil and/or synthetic oil is used as the base oil. In a preferred embodiment of the present invention, from about 2% to about 35% by weight of urea-based thickener is used with respect to the total weight of the grease composition.

It is also possible to add various additives such as antioxidants, rust preventers and extreme-pressure agents to the grease composition of the present invention.

Preferred lubricating grease compositions for constant velocity joints according to the invention specifically described herein have considerably improved flaking resistance and seizing resistance (damage resistance) and also have excellent abrasion resistance and temperature-control properties.

The present invention will now be described with reference to the following examples, which are not intended to limit the scope of the present invention in any way.

EXAMPLES

Preparation of Grease Compositions

Additives were added to base grease according to the formulations shown in Tables 1 to 3, and the resulting systems were treated using a 3-roller mill to yield grease for the Working Examples and Comparative Examples. It should be noted that purified mineral oil having a kinematic viscosity of 15 $mm^2/s$ at 100° C. was used as the base oil.

I Diurea Grease 1 mol of diphenylmethane-4,4'-diisocyanate and 2 mol of octylamine were reacted in base oil, and the resulting urea compound was uniformly dispersed to yield base grease. The urea compound content was set at about 10% by weight.

II Tetraurea Grease 2 mol of diphenylmethane-4,4'-diisocyanate, 2 mol of octylamine and 1 mol of ethylene diamine were reacted in base oil and the resulting urea compound was dispersed uniformly to yield base grease. The urea compound content was set at about 15% by weight.

The thickness, abrasion resistance, joint damage and joint durability shown in the accompanying tables were appraised according to the following test methods.

(1) Thickness was appraised according to JIS K2220 5.3

(2) Abrasion resistance was appraised according to ASTM D2266.

(3) Joint damage test

Each sample was introduced into a commercial CVJ and the system was operated under the following conditions, then the presence or absence of the fine damage that is a sign of flaking inside the joint was appraised, and the maximum temperature of the joint during the operation was also appraised.

CVJ type: Barfield joint
rpm: 1500 rpm
Joint angle: 8°
Torque: 300 N.m
Time: 1 hour
Appraisal: (O) no damage; x damage; Δ slight damage (4) Joint durability test Each sample was introduced into a commercial CVJ and the system was operated under the following conditions, then the presence or absence of flaking or seizure of the ball in the joint or of the inner race, outer race or cage was appraised.

CVJ type: Barfield joint
rpm: 1500 rpm
Joint angle: 8°
Torque: 300 N.m
Time: 150 hours
Appraisal: (O) no damage; Δ slight flaking; x flaking (continued use impossible)

TABLE 1

| | | Working Example 1 | Working Example 2 | Working Example 3 |
|---|---|---|---|---|
| Base grease (% wt) | Diurea grease | 95.0 | 95.0 | — |
| | Tetraurea grease | — | — | 95.0 |
| Additives (% wt) | A-1 *1 | 3.0 | 2.0 | — |
| | A-2 *2 | — | — | 2.0 |
| | B *3 | 2.0 | 0.5 | 0.5 |
| | C *4 | — | 1.0 | 1.0 |
| Test results | Thickness 60 W | 320 | 316 | 318 |
| | Abrasion resistance (mm) | 0.47 | 0.40 | 0.39 |
| | Joint damage test | (O) | (O) | (O) |
| | Joint temperature (° C.) | 128 | 101 | 108 |
| | Joint durability test | (O) | (O) | — |

TABLE 2

| | | Comparative Example 1 | Comparative Example 2 | Comparative Example 3 |
|---|---|---|---|---|
| Base grease (% wt) | Diurea grease | 92.0 | 96.0 | 98.0 |
| | Tetraurea grease | — | — | — |
| Additives (% wt) | A-1 *1 | 3.0 | 3.0 | — |
| | A-2 *2 | — | — | — |
| | B *3 | — | — | 2.0 |
| | C *4 | 1.0 | 1.0 | |
| | 2,5-bis (tert-octyldithio)-1,3,4-thiadiazole | 4.0 | — | — |
| | Zinc dialkyl dithiophosphate | — | — | — |
| | Molybdenum disulphide | — | — | — |
| Test results | Thickness 60 W | 312 | 326 | 321 |
| | Abrasion resistance (mm) | 0.45 | 0.39 | 0.55 |
| | Joint damage test | Δ | x | x |
| | Joint temperature (° C.) | 120 | 107 | 154 |
| | Joint durability test | Δ | x | — |

TABLE 3

| | | Comparative Example 4 | Comparative Example 5 | Comparative Example 6 |
|---|---|---|---|---|
| Base grease (% wt) | Diurea grease | 96.0 | 96.0 | 92.0 |
| | Tetraurea grease | — | — | — |
| Additives (% wt) | A-1 *1 | — | 3.0 | 3.0 |
| | A-2 *2 | — | — | — |
| | B *3 | 1.0 | — | — |
| | C *4 | 1.0 | — | — |
| | 2,5-bis (tert-octyldithio)-1,3,4-thiadiazole | 2.0 | — | — |
| | Zinc dialkyl dithiophosphate | — | 1.0 | — |
| | Molybdenum disulphide | — | — | 5.0 |
| Test results | Thickness 60 W | 322 | 318 | 316 |
| | Abrasion resistance (mm) | 0.48 | 0.41 | 0.65 |
| | Joint damage test | x | x | x |
| | Joint temperature (° C.) | 106 | 108 | 118 |
| | Joint durability test | — | x | — |

*1 A-1 is a molybdenum sulphide dialkyldithiocarbamate mixture where the alkyl groups have 4 carbon atoms and n is 2 and 3.
*2 A-2 is a molybdenum sulphide dialkyldithiocarbamate compound where the alkyl groups have 4 carbon atoms and n is 4.
*3 B is the thiadiazole compound 5,5'-dithiobis(1,3,4-thiadiazole-2-thiol).
*4 C is triphenylphosphorothionate.

We claim:

1. A grease composition for constant velocity joints, comprising a base oil and a urea-based thickener, which grease additionally contains, (A) molybdenum sulphide dialkyldithiocarbamate and (B) 5,5'-dithiobis(1,3,4-thiadiazole-2-thiol).

2. The grease composition according to claim 1, containing from about 0.5% to about 10% by weight of (A) molybdenum sulphide dialkyldithiocarbamate and from 0.1% to 10% by weight of (B) 5,5'-dithiobis(1,3,4-thiadiazole-2-thiol), with respect to the total weight of grease composition.

3. The grease composition according to claim 1, wherein said grease contains from about 0.5% to about 5% by weight of (A) molybdenum sulphide dialkyldithiocarbamate and 0.1% to about 5% by weight of (B) 5,5'-dithiobis(1,3,4-thiadizole-2-thiol), with respect to the total weight of grease composition.

4. The grease composition according to claim 1, wherein said grease contains from about 2% to about 35% by weight of urea-based thickener, with respect to the total weight of the grease composition.

5. The grease composition according to claim 1, wherein (A) molybdenum sulphide dialkyldithiocarbamate is selected from one or more of molybdenum sulphide diethyldithiocarbamate, molybdenum sulphide dibutyldithiocarbamate, molybdenum sulphide diisobutyldithiocarbamate, molybdenum sulphide di(2-ethylhexyl)dithiocarbamate, molybdenum sulphide diamyldithiocarbamate, molybdenum sulphide diisoamyldithiocarbamate, molybdenum sulphide dilauryldithiocarbamate, molybdenum sulphide distearyldithiocarbamate, molybdenum sulphide n-butyl-2-ethylhexyldithiocarbamate and molybdenum sulphide 2-ethylhexylstearyldithiocarbamate.

6. The grease composition according to claim 1, which further contains, (C) triphenylphosphorothionate.

7. The grease composition for according to claim 6, containing from about 0.1% to about 10% by weight of (C) triphenylphosphorothionate, with respect to the total weight of grease composition.

8. The grease composition according to claim 6, wherein said grease contains from about 0.1% to about 5% by weight of (C) triphenylphosphorothionate, with respect to the total weight of grease composition.

9. A method of lubricating a constant velocity joint comprising packing it with a grease according to claim 1.

10. A constant velocity joint packed with a grease according to claim 1.

* * * * *